US006758060B2

(12) United States Patent
O'Brien

(10) Patent No.: US 6,758,060 B2
(45) Date of Patent: Jul. 6, 2004

(54) SEPARATING NITROGEN FROM METHANE IN THE PRODUCTION OF LNG

(75) Inventor: John V. O'Brien, Shrewsbury, MA (US)

(73) Assignee: Chart Inc., Mayfield Heights, OH (US)

( * ) Notice: Subject to any disclaimer, the term of this patent is extended or adjusted under 35 U.S.C. 154(b) by 0 days.

(21) Appl. No.: 10/367,148

(22) Filed: Feb. 14, 2003

(65) Prior Publication Data

US 2003/0177786 A1 Sep. 25, 2003

Related U.S. Application Data

(60) Provisional application No. 60/357,581, filed on Feb. 15, 2002.

(51) Int. Cl.[7] ..... F25J 3/00
(52) U.S. Cl. ..... 62/631; 62/927
(58) Field of Search ..... 62/620, 927, 630, 62/631

(56) References Cited

U.S. PATENT DOCUMENTS

| | | | | |
|---|---|---|---|---|
| 2,940,271 A | * | 6/1960 | Jackson | 62/623 |
| 3,874,184 A | * | 4/1975 | Harper et al. | 62/628 |
| 4,158,556 A | * | 6/1979 | Yearout | 62/622 |
| 4,352,685 A | | 10/1982 | Swallow | |
| 4,415,345 A | | 11/1983 | Swallow | |
| 4,479,871 A | | 10/1984 | Pahade et al. | |
| 4,501,600 A | | 2/1985 | Pahade | |
| 4,592,767 A | | 6/1986 | Pahade et al. | |
| 4,664,686 A | | 5/1987 | Pahade et al. | |
| 4,710,212 A | | 12/1987 | Hanson et al. | |
| 4,778,498 A | | 10/1988 | Hanson et al. | |
| 4,878,932 A | | 11/1989 | Phade et al. | |
| 4,948,405 A | * | 8/1990 | Thompson | 62/630 |
| 5,026,408 A | | 6/1991 | Saunders et al. | |
| 5,041,149 A | | 8/1991 | Handley | |
| 5,051,120 A | | 9/1991 | Pahade et al. | |
| 5,617,741 A | * | 4/1997 | McNeil et al. | 62/622 |
| 6,070,429 A | | 6/2000 | Low et al. | |
| 6,158,240 A | | 12/2000 | Low et al. | |

OTHER PUBLICATIONS

"Linde Technology," *Reports on Science and Technology*, Jan. 2003, pp. 1–52, Linde AG, Wiesbaden, Germany.

* cited by examiner

*Primary Examiner*—William C. Doerrler
(74) *Attorney, Agent, or Firm*—Calfee, Halter & Griswold, LLP

(57) ABSTRACT

Substantially all the nitrogen is removed from natural gas during the production of LNG, without producing mixed nitrogen/methane streams needing recycle and further processing, or requiring compression for burning as fuel, by operating both the high pressure and the low pressure multistage distillation towers of a two column cryogenic nitrogen rejection unit to produce acceptable liquefied natural gas as tower bottom products, while the low pressure tower is further operated to produce as an overhead a gas steam containing no more than about 1% methane for safe venting to the atmosphere.

34 Claims, 2 Drawing Sheets

SEPARATING NITROGEN FROM METHANE IN THE PRODUCTION OF LNG

CROSS-REFERENCE TO RELATED APPLICATION

This application is based on provisional application S. No. 60/357,581, filed Feb. 15, 2002, the disclosure of which is incorporated herein by reference and the benefit of which is hereby claimed.

FIELD OF INVENTION

The present invention relates to separating nitrogen from methane in the production of liquefied natural gas ("LNG").

BACKGROUND

U.S. Pat. No. 6,070,429 to Low et al., the disclosure of which is incorporated herein by reference, describes a process for removing nitrogen from natural gas and other methane-containing gases during the production of LNG. In this process, a nitrogen recovery unit ("NRU") composed of three separate multistage stripping towers is used to recover a high purity nitrogen stream (stream 438) which can be vented to the atmosphere. Also produced are two mixed nitrogen/methane streams, one containing about 10% nitrogen (stream 440) and the other containing about 2.8% nitrogen (stream 436), which are recycled to the open methane cycle gas stream. Because of this recycle, extra horsepower must be expended in operating the cascaded refrigeration system of the plant due to the nitrogen content of these recycled streams.

SUMMARY OF THE INVENTION

In accordance with the present invention, it has been found that substantially all the nitrogen can be removed from natural gas during the production of LNG, without producing mixed nitrogen/methane streams needing recycle and further processing, by operating both the high pressure and the low pressure multistage distillation towers of a two column cryogenic nitrogen rejection unit to produce acceptable natural gas liquids as tower bottom products, while the low pressure tower is further operated to produce as an overhead a nitrogen gas steam preferably containing no more than about 1% methane for safe venting to the atmosphere.

Thus, the present invention provides a process for removing nitrogen from a methane-containing feed gas during the production of a liquefied natural gas product using a two column cryogenic nitrogen recovery unit having a high pressure multistage distillation tower and a low pressure multistage distillation tower, the process comprising separating the feed gas in the high pressure multistage distillation tower into a first methane-rich liquid bottoms containing a reduced nitrogen content and a first vaporous overhead, at least partially condensing the first vaporous overhead into a liquid intermediate stream, separating the liquid intermediate stream in the low pressure multistage distillation tower into a second methane rich bottoms containing a reduced nitrogen content and a second vaporous overhead containing a substantial portion of the nitrogen in the feed gas and a substantially reduced methane content, and recovering the first methane-rich liquid bottoms and the second methane-rich liquid bottoms as the liquid natural gas product of the process.

BRIEF DESCRIPTION OF THE DRAWINGS

The present invention may be more readily understood by reference to the following drawings wherein.

DETAILED DESCRIPTION

Feed Gas

The present invention is directed to removing a substantial portion, and preferably substantially all, of the nitrogen from natural gas and other methane gas streams during the production of LNG. A variety of different methane containing gas streams can be used for producing LNG. Such streams typically contain as little as about 5% and as much as 50% or more of nitrogen. Nitrogen concentrations of about 8 to 30%, and especially about 10 to 20%, are more typical.

The present invention can be used to remove a substantial portion of the nitrogen content of any such streams for producing an LNG product with a reduced nitrogen content. By a "substantial portion" and a "reduced nitrogen content" is meant in this context that enough of the nitrogen in the feed gas is removed to produce an LNG product having the desired nitrogen content. Normally, this means that enough of the nitrogen will be removed so that the LNG product has an nitrogen content of about 1% or less, 0.75% or less, or even 0.5% or less. In some instances, LNG product containing 2%, 3% or 4% are acceptable. The inventive process can be practiced to produce any and all of these LNG products. Preferably, substantially all of the nitrogen content will be removed, thereby producing LNG product containing about 1% or less of nitrogen.

The present invention is described below in connection with a particular nitrogen-containing methane-rich gas stream having the following composition:

TABLE 1

Composition of Exemplary Methane-Containing Feed Gas

| Component | % V/V |
|---|---|
| $N_2$ | 11.87 |
| $CO_2$ | 60 ppmv |
| $CH_4$ | 74.34 |
| $C_2H_6$ | 11.52 |
| $C_3H_8$ | 1.19 |
| $iC_4H_{10}$ | 0.142 |
| $NC_4H_{10}$ | 0.680 |
| $iC_5H_{12}$ | 0.101 |
| $NC_5H_{12}$ | 0.122 |
| $NC_6H_{14}$ | 0.0274 |
| $C_6H_6$ | 0.0030 |
| Total: | 100.00 |

However, it will be appreciated that the present invention is applicable to processing any gas stream containing a predominant amount of methane and a substantial amount of nitrogen.

In addition, it is also well known that natural gas often contains various contaminants such as water vapor and other acid gas components, which are substantially removed before nitrogen removal in conventional practice. Such contaminants are preferably removed before processing in accordance with the present invention as well.

Processing Scheme

Figure 1:
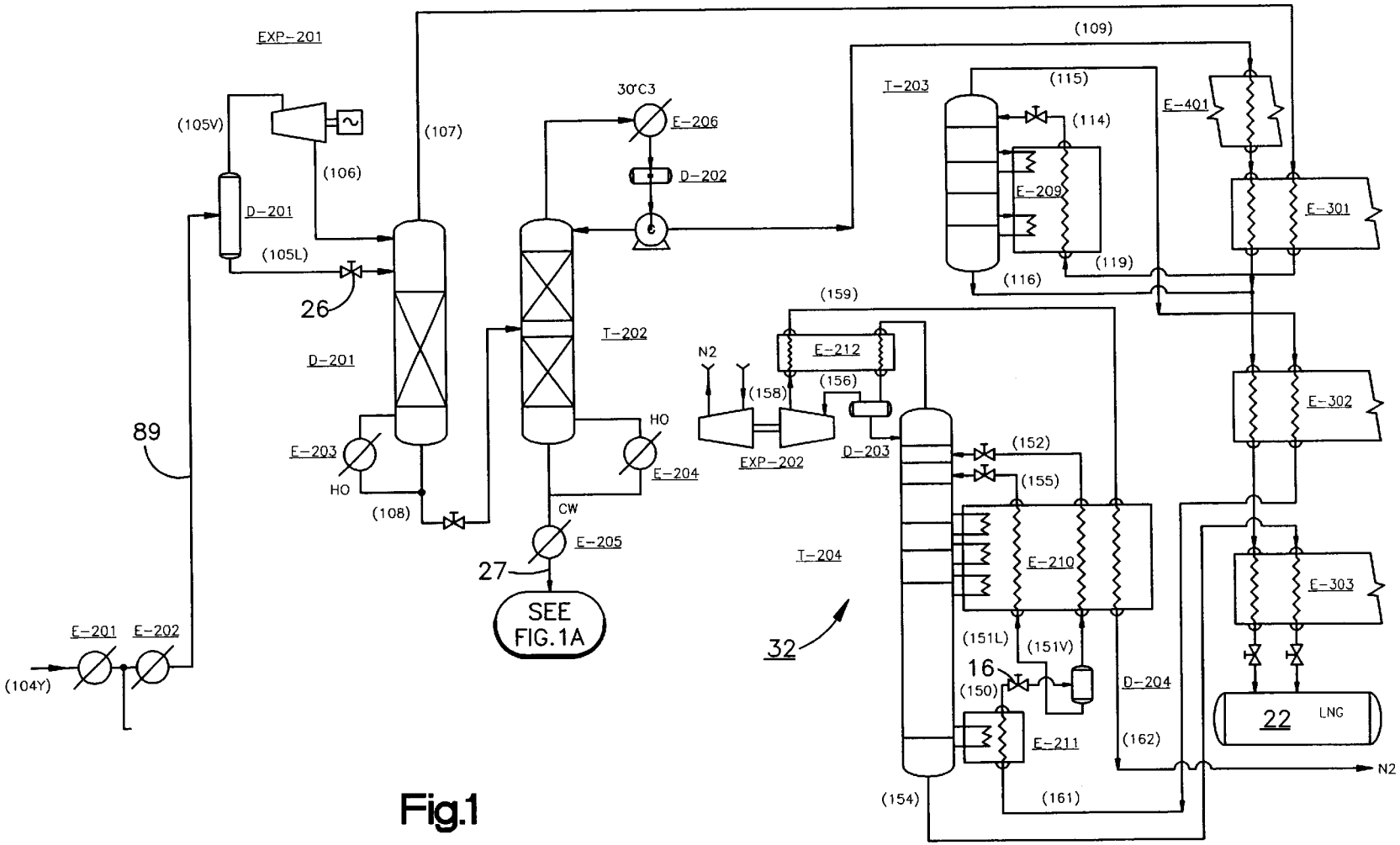
FIGS. 1 and 1A are schematic representations of the nitrogen recovery unit of an LNG plant constructed and operated in accordance with the principles of the present invention.
Figure 1A:
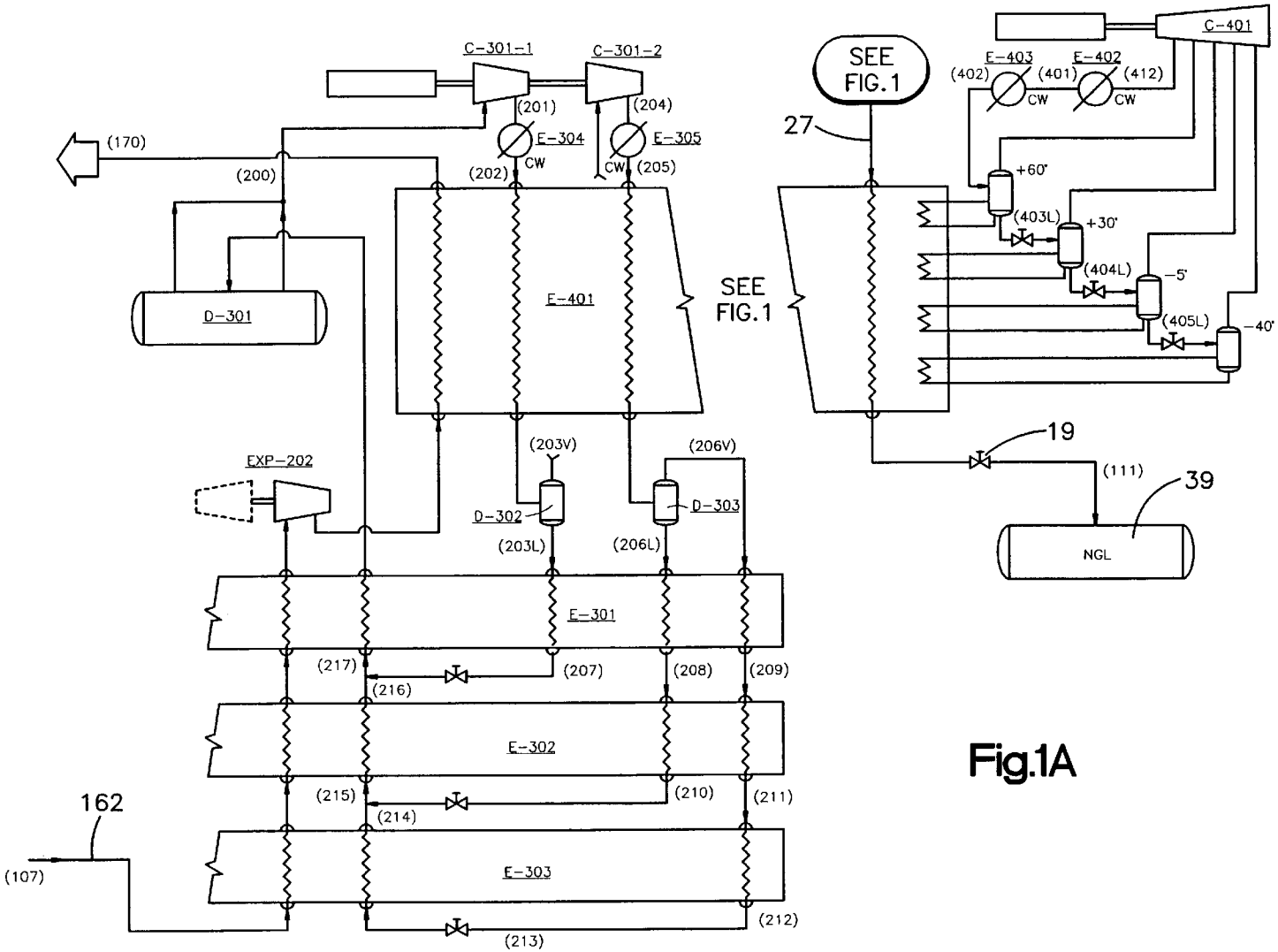

FIGS. 1 and 1A schematically illustrate a particular embodiment of the inventive process for rejecting nitrogen from natural gas and other methane gas streams in the manufacture of LNG. This illustration is made using an exemplary feed gas having the composition specified in Table 1 above and which has been previously treated to remove various contaminants such as acid gas components and water vapor to acceptable levels.

Removal $C_{3+}$ Components

Preferably, the inventive process begins with the removal of $C_{3+}$ components, as these components may cause freezing problems and may also result in an LNG product having too high a heating value. Of course, where this is not problem, this removal step can be avoided.

As shown in FIG. 1, removal of $C_{3+}$ components can be accomplished by passing the feed gas initially at a pressure of about 1,300 psig and a temperature of about 65° F. via conduit 104Y into heat exchanger E-201 and heat exchanger E-202 where it is chilled by propane to its dew point of about 0° F. The gas is then fed via conduit 89 to separator D-201, where it is separated into vaporous overhead stream 105V and a bottoms liquid stream 105L. Separator D-201 insures that essentially no liquid is present in overhead stream 105V. Vaporous overhead stream 105V is then expanded isentropically to about 550 psig in expander EXP-201, which produces a mixed liquid/vapor stream in conduit 106 containing about 8.8% liquid at about −69.5° F.

The mixed liquid/vapor stream in conduit 106 is then passed into an upper portion the top of multistage stripper or demethanizer tower T-201. In addition, bottoms liquid stream 105L is also introduced into an upper portion of demethanizer tower T-201, together with vaporous overhead stream 105V, after passing through expansion valve 26 to reduce its pressure to about 550 psig. Demethanizer tower T-201 is operated at a pressure of about 550 psig so as to produce a demethanizer overhead vapor containing about 12.36% nitrogen, 77.38% methane and 9.68% ethane as well as a demethanizer bottoms liquid product containing essentially no methane, i.e., about 0.1% methane, and 56.4% ethane. The balance of this bottoms stream comprises $C_{3+}$ components. In this condition, the top and bottom temperatures of demethanizer tower T-201 are about −66° F. and 135° F., respectively. As understood in the art, demethanizer tower T-201 could be operated at any other convenient pressure and temperature for accomplishing this result.

Next, the demethanizer bottoms are withdrawn through conduit 108, passed through expansion valve 44 for pressure reduction and passed into multistage distillation column, deethanizer tower T-202. Deethanizer tower T-202 is operated at a pressure of about 360 psig with a top temperature of about 37° F. and a bottom temperature of about 211.6° F. This produces a deethanizer overhead vapor comprising about 99% ethane and about 1% propane and a deethanizer bottoms liquid containing about 41% propane and about 41% $C_4$'s, with the balance being methane, ethane and $C_{5+}$ components. Deethanizer tower T-202 could be operated at any other convenient pressure and temperature for accomplishing this result, as well appreciated in the art. The deethanizer overhead vapor is condensed substantially completely by cooling with propane to a temperature of about 30° F. in exchanger E-206. A portion of this liquid overhead stream is returned as reflux to the top of deethanizer tower T-202, while the remainder is sent via conduit 109 to blend with the LNG product in line 115, as further discussed below.

The deethanizer bottoms liquid from deethanizer tower T-202, after being cooled with cold water in exchanger E-205, is passed through conduit 27 into propane refrigeration cycle exchanger E-401 (FIG. 1A) where is further cooled by propane to −35° F. The cooled stream so obtained is passed through expansion valve 19 to reduce its pressure to about 1 psig and then through line 111 to NGL storage tank 39. As can be seen, the components forming this NGL liquid product have been fractionated away from the LNG product by this approach. Moreover, a pure ethane stream is produced which can be reinjected into the LNG product or sold as a separate product. It can also be used as a component in a mixed refrigerant process.

Nitrogen Removal

In accordance with the present invention, nitrogen is removed from the feed gas in the form of an nitrogen-rich by product gas stream which can be safely vented to the atmosphere, and without producing mixed nitrogen/methane streams needing recycle and further processing, by passing the demethanizer tower overhead vapor stream produced in demethanizer tower T-201 through the two column cryogenic nitrogen rejection unit ("NRU") generally shown at 32 in FIG. 1.

Two column NRU's are known in the art. In general, they rely on only two distillation columns for separating the nitrogen and methane components of the feed from one another. An example of such a system used for the production of pipeline gas is shown in U.S. Pat. No. 4,664,686, the disclosure of which is incorporated herein by reference. In these systems, the feed gas is passed into the high pressure column of the NRU to produce a liquid bottoms product having a reduced nitrogen content and a vaporous overhead with increased nitrogen content. The vaporous overhead is then fed to the low pressure column of the NRU, after first passing in indirect heat exchange with the liquid bottoms of the low pressure column, where it is separated into a low pressure overhead containing most of the nitrogen in the feed and a low pressure bottoms product with a substantially reduced nitrogen content. In this disclosure, the liquid phase bottoms products from both towers are revaporized and ultimately exported as pipeline gas.

As shown in FIG. 1, the demethanizer overhead vapor in conduit 107 is partially condensed in the warm mixed refrigerant cycle exchanger E-301 and then fully condensed in reboiler heat exchanger E-209 at the bottom of NRU high pressure tower T-203. Tower-203 is operated to produce a first vaporous overhead containing about 30% nitrogen and a first LNG liquid bottoms product containing substantially no nitrogen, typically about 1% or less. In the particular embodiment shown, tower T-203 is operated at a pressure of about 350 psig, a top temperature of about −162° F. and a bottom temperature of about −141° F. As understood in the art, tower T-203 could be operated at any other convenient pressure and temperature for this purpose. A substantial amount, roughly about half (½) to about two thirds (⅔) of the $CH_4$ in the feed gas, is recovered in this stream as LNG product of the system. Prior to charging into LNG product tank 22, however, this LNG product is combined with the deethanizer tower liquid phase overhead stream 109 passing out of exchanger E-301 for further cooling in exchangers E-302 and E-303 of the mixed refrigerant cycle system.

The first vaporous overhead passing out of high pressure tower T-203 via conduit 115 is condensed in mid-temperature mixed refrigerant cycle exchanger E-302 and then fed to bottom reboiler E-211 of NRU low pressure tower T-204 where it is cooled further. The subcooled liquid in conduit 150, after passing through expansion valve 16 is flashed in tower feed separator drum D-204 at about 150 psig to produce liquid fraction 151L and vapor fraction 151V. Vapor fraction 151V is condensed in side reboiler E-210 and fed to an upper zone of low pressure tower T-204. Liquid fraction 151L is subcooled in side reboiler E-210 and fed to an upper zone of low pressure tower T-204 below condensed vapor fraction 151V.

Low pressure tower T-204 is operated to produce a low pressure tower or second liquid bottoms product containing a reduced nitrogen content, preferably substantially no nitrogen (i.e. typically about 1% nitrogen or less). Tower T-204 also produces a low pressure tower or second vaporous overhead containing substantially all of the nitrogen in the feed gas and a substantially reduced $CH_4$ content, i.e. a methane content of about 4% or less, more typically about 1% methane or less. In addition, this stream will also typically contain 96% or more nitrogen, more typically about 98% or more, or even 99% or more, nitrogen in order that it can be safely discharged into the atmosphere. In the particular embodiment shown, this is done by operating tower T-204 at about 50 psig with a bottom temperature of about −223° F. and a top temperature of about −283° F. In addition, the vaporous overhead is rectified to contain its low nitrogen content by partial condensation in overhead exchanger E-212, with the liquid phase from this rectification being returned from separator drum D-203 to the top of low pressure tower T-204. As understood in the art, tower T-204 could be operated at any other convenient pressure and temperature for accomplishing this result. In the particular embodiment shown, tower T-204 is operated at adequate pressure so the liquid methane bottoms product can flow to the LNG product tank, as further discussed below, without the use of pumps.

The second liquid bottoms product, i.e. the liquid bottoms product of low pressure tower T-204, typically contains substantially all of the remaining methane in the feed gas, typically about one-third (⅓) to one-half (½) of the methane originally present, and represents additional LNG product of the system. As shown in FIG. 1, this bottoms stream, after being further cooled in cold mixed refrigerant cycle exchanger E-303, is charged into liquid LNG storage tank 22 after depressurizing to about 1 psig.

The second vaporous overhead, i.e., the vaporous overhead product of low pressure tower T-204 and containing a substantial portion, and preferably substantially all, of the nitrogen in the feed gas, after rectification in exchanger E-212, is expanded in expander/compressor EXP-202 to 5 psig. This creates about 6.3% liquid in the expander exhaust, which serves as a coolant when this stream is passed via line 158 through exchanger E-212. After passing out of exchanger E-212, this stream is further heated to about −259° F. in cold mixed refrigerant cycle exchanger E-303. It is then charged via line 162 into mixed refrigerant cycle exchangers E-303, E-302 and E-301, respectively, for cold recovery (See, FIG. 1A), pressurized in expander/compressor EXP-202, passed through propane refrigeration cycle exchanger E-401 for additional cold recovery, and finally vented to the atmosphere through line 170.

From the above, it can be seen that the LNG product made by this system is derived from the separated ethane-rich stream 109 produced as the overhead product of deethanizer tower T-202 as well as the bottoms streams from the two NRU towers. For this purpose, ethane-rich stream 109 is subcooled to −35° F. in exchanger E-401 by propane refrigeration, and then to −134° F. in warm mixed refrigerant cycle exchanger E-301. Ethane-rich stream 109 is then combined with the liquid bottoms product 116 of high pressure NRU tower T-203 and then subcooled to −200° F. in mid-temperature mixed refrigerant cycle exchanger E-302 and further to −262° F. in cold mixed refrigerant cycle exchanger E-303. It is then depressurized to the LNG tank at 1 psig. The other stream forming the LNG product, low pressure tower bottoms 154, is also subcooled to −262° F. in cold mixed refrigerant cycle exchanger E-303, depressurized to about 1 psig, and fed to the LNG tank.

Refrigeration Cycles

The inventive nitrogen removal system is applicable any system for the liquefaction of natural gas in which the gas is passed at elevated pressure through multiple cooling stages to successively cool the gas to lower temperatures until the liquefaction temperature is reached. Many such systems are known, each using its own particular way or methodology for the many different refrigeration and separating steps employed. The following is a description of the refrigeration cycles in an exemplary LNG plant in which the inventive nitrogen removal system can also be used. LNG plants with any other system of refrigeration cycles can also be employed.

In the particular LNG plant illustrated in FIGS. 1 and 1A, two independent, cascaded cycles are used, a mixed refrigerant cycle operating over the temperature range −35 to −262° F. and a propane refrigeration cycle which covers the range from ambient temperature to −35° F. This mixed refrigerant cycle employs the following components in the following total amounts:

TABLE 2

Components of Mixed Refrigerant Cycle

| Components | % V/V |
|---|---|
| $N_2$ | 9 |
| $CH_4$ | 42 |
| $C_2H_6$ | 40 |
| $C_3H_8$ | 9 |
| Total: | 100 |

This mixed refrigerant stream 200 is compressed from 29 psig, −45° F. to 159 psig in the first stage of compressor C-301 (FIG. 1A). The stream is then cooled by water in exchanger E-304, then cooled to −35° F. by propane in exchanger E-401 where it is partly condensed. The liquid is separated in drum D-302, and the vapor 203V is further compressed in the second stage of compressor C-301 to 570 psig. This stream is then water cooled in exchanger E-305, partially condensed to −35° F. in exchanger E-401, vapor/liquid separated in drum D-303, thereby producing streams 206V and 206L.

The required refrigeration duties and temperatures are produced in the three heat exchangers E-301, E-302 and E-303. In exchanger E-301, the Warm Mixed Refrigerant Exchanger, the three refrigerant streams 203L, 206L and 206V are cooled to 134° F. The first liquid is depressurized to the low pressure stream 217. In exchanger E-302, the Mid Temperature Mixed Refrigerant Exchanger, the remaining streams 208 and 209 are cooled to −200° F. and the high pressure liquid stream flashed to low pressure stream 215. Final cooling is done in the Cold Mixed Refrigerant Exchanger E-303. There, stream 211 is subcooled to −262° F. to form stream 212, which in turn is flashed to low pressure stream 213.

These vaporizing streams then supply the refrigeration for each temperature range. The low pressure refrigerant emerges as all vapor at stream 200, which is fed to the first stage of compressor C-301.

The Propane Cycle

The propane cycle used in the LNG plant illustrated above is conventional. In this cycle, there four levels of refrigeration at +60° F., +30° F., −5° F. and 40° F. sideloads to the propane compressor C-401. The propane is condensed by water in E-402, then subcooled by water in E-403.

Working Example

The operation of a hypothetical LNG plant, configured in accordance with the schematic illustrations of FIGS. 1 and 1A and sized to produce 1.5 MTPA (million tons per year) LNG using a feed gas having the composition set forth in Table 1 above, was determined by computer simulation.

A material balance showing the compositions of the feed and products, and based on 350 days operation per year, is set forth in the following Table 3. Power consumptions needed to run the compressors used in the plant are set forth in the following Table 4:

TABLE 3

Material Balance

| Stream name<br>Stream ID | Treated feed gas<br>104Y | NGL in storage<br>111 | LNG in storage<br>LNG | Nitrogen vented<br>170 |
|---|---|---|---|---|
| Flows, lbmol/hr | | | | |
| NITROGEN | 2946.115 | | 210.754 | 2735.620 |
| CARBON DIOXIDE | 1.498 | | 1.498 | |
| METHANE | 18445.953 | | 18418.621 | 27.631 |
| ETHANE | 2857.983 | 12.943 | 2845.019 | |
| PROPANE | 294.611 | 177.658 | 116.951 | |
| ISOBUTANE | 35.253 | 29.630 | 5.723 | |
| n-BUTANE | 168.709 | 150.200 | 18.509 | |
| ISOPENTANE | 25.180 | 24.221 | 0.960 | |
| n-PENTANE | 30.217 | 29.417 | 0.799 | |
| n-HEXANE | 6.799 | 6.767 | 0.042 | |
| BENZENE | 0.755 | 0.750 | 0.005 | |
| Total, lbmol/hr | 24813.072 | 431.475 | 21618.881 | 2763.251 |
| Stream flow, MMscfd | 226.0 | 3.9 | 196.9 | 25.2 |
| Total, lb/hr | 493948 | 23181 | 393701 | 77078 |
| Pressure, psig | 1296 | 1 | 1 | 1 |
| Temperature, F. | 65 | −32.9 | −259.9 | 90 |
| Flowing sp. gr. | | 0.5204 | 0.4681 | |
| Liquid flow, metric tons/d | | 252.4 | 4286.0 | |
| Liquid flow, m3/d | | 406.8 | 9156.1 | |
| Composition, mol % | | | | |
| NITROGEN | 11.873 | 0.000 | 0.975 | 99.000 |
| CARBON DIOXIDE | 0.006 | 0.000 | 0.007 | 0.000 |
| METHANE | 74.340 | 0.000 | 85.197 | 1.000 |
| ETHANE | 11.518 | 3.000 | 13.160 | 0.000 |
| PROPANE | 1.187 | 41.175 | 0.541 | 0.000 |
| ISOBUTANE | 0.101 | 5.614 | 0.004 | 0.000 |
| n-BUTANE | 0.680 | 34.811 | 0.086 | 0.000 |
| ISOPENTANE | 0.101 | 5.614 | 0.004 | 0.000 |
| n-PENTANE | 0.122 | 6.818 | 0.004 | 0.000 |
| n-HEXANE | 0.027 | 1.566 | 0.000 | 0.000 |
| BENZENE | 0.003 | 0.174 | 0.000 | 0.000 |
| Total | 100.000 | 100.000 | 100.000 | 100.000 |

TABLE 4

Compressor Power Consumption

| | |
|---|---|
| Total mixed refrigeration compressor | 44,533 HP |
| Total propane compressor | 35,185 HP |
| Total compression | 79,718 HP (59,469 kW) |

This power consumption translates into specific consumptions (using the stream flows from the balance for the LNG product) of 79,718/196.9=405 HP/MMSCFD (59,469/4,286=13.9 kW/t/d on a metric basis).

From the foregoing, it can be seen that the present invention provides an effective way of separating nitrogen from methane gas streams at low specific power consumption during the production of LNG without producing by product mixed nitrogen/$CH_4$ streams needing recycle and further processing. This results in a significant cost reduction in both capital and power costs compared with other approaches, because processing of recycled nitrogen has been eliminated as a practical matter.

Furthermore there is no fuel gas stream with substantial quantities of nitrogen. Nitrogen rejection in other applications has been achieved by flashing off the nitrogen at low pressure prior to the LNG being sent to the LNG tank. This nitrogen, together with the flashed methane has to be compressed to reach the fuel gas pressure required for gas turbine drivers. This fuel gas compression is eliminated in accordance with the essentially complete nitrogen rejection of the present invention.

Also, in a cascade cycle where an open methane cycle is used, the purified stream from either of the nitrogen rejection towers can be used as the refrigerant fluid. This eliminates the recycling of large quantities of nitrogen and the associated compression costs. This leverages up to further savings in the warmer level refrigeration cycles where any recycled nitrogen has to be condensed.

Although only a few embodiments of the present invention have been described above, is should be appreciated that many modifications can be made without departing from the spirit and scope of the invention. All such modifications are intended to be included within the scope of the present invention, which is to be limited only by the following claims:

I claim:

1. A process for removing nitrogen from a methane-containing feed gas during the production of a liquefied natural gas product using a two column cryogenic nitrogen rejection unit having a high pressure multistage distillation tower and a low pressure multistage distillation tower, the process comprising (a) separating the feed gas in the high pressure multistage distillation tower into a first methane-rich liquid bottoms stream containing a reduced nitrogen content and a first vaporous overhead stream, (b) at least partially condensing the first vaporous overhead stream into a liquid intermediate stream, (c) separating the liquid intermediate stream in the low pressure multistage distillation tower into a second methane rich liquid bottoms stream containing a reduced nitrogen content and a second vaporous overhead stream containing a substantial portion of the nitrogen in the feed gas and a substantially reduced methane content, and (d) recovering the first methane-rich liquid bottoms stream and the second methane-rich liquid bottoms stream as the liquid natural gas product.

2. The process of claim 1, wherein the liquid natural gas product contains about 4% or less nitrogen and further wherein the second vaporous overhead contains about 4% or less methane.

3. The process of claim 2, wherein the liquid natural gas product contains about 1% or less nitrogen and further wherein the second vaporous overhead contains about 1% or less methane.

4. The process of claim 1, wherein the first methane-rich liquid bottoms and the second methane-rich liquid bottoms are combined to produce the liquid natural gas product.

5. The process of claim 1, wherein the feed gas contains about 5 to 50% nitrogen.

6. The process of claim 1, wherein $C_{3+}$ components are substantially removed from the feed gas before the feed gas is fed to the nitrogen rejection unit.

7. The process of claim 6, wherein the $C_{3+}$ components are substantially removed by fractionating the feed gas to recover the $C_{3+}$ components as a demethanizer liquid bottoms product, said process further comprising fractionating the demethanizer liquid bottoms product to recover the $C_{3+}$ components as a deethanizer liquid bottoms product and to produce an ethane-rich deethanizer overhead stream.

8. A process for removing nitrogen from a methane-containing feed gas during the production of a liquefied natural gas product using a two column cryogenic nitrogen rejection unit having a high pressure multistage distillation tower and a low pressure multistage distillation tower, the process comprising (a) fractionating the feed gas to recover the $C_{3+}$ components as a demethanizer liquid bottoms product and a demethanizer overhead product, (b) fractionating the demethanizer liquid bottoms product to recover the $C_{3+}$ components as a deethanizer liquid bottoms product and to produce an ethane-rich deethanizer overhead stream, (c) separating the demethanizer overhead product in the high pressure multistage distillation tower into a first methane-rich liquid bottoms stream containing a reduced nitrogen content and a first vaporous overhead stream, (d) at least partially condensing the first vaporous overhead stream into a liquid intermediate stream, (e) separating the liquid intermediate stream in the low pressure multistage distillation tower into a second methane rich liquid bottoms stream containing a reduced nitrogen content and a second vaporous overhead stream containing a substantial portion of the nitrogen in the feed gas and a substantially reduced methane content, and combining the ethane-rich deethanizer overhead stream with the first liquid bottoms stream produced by the high pressure multistage distillation tower of the nitrogen recovery unit to recover the first methane-rich liquid bottoms stream, the second methane-rich liquid bottoms stream and the ethane-rich deethanizer overhead stream as the liquid natural gas product.

9. The process of claim 8, wherein each of the first liquid bottoms stream, and second liquid bottoms stream have nitrogen contents of about 1% or less.

10. The process of claim 1, wherein the low pressure multistage distillation column is operated at a pressure sufficient to propel the liquid product bottoms stream produced by this column to a remote LNG storage tank without pumping.

11. The process of claim 1, wherein each of the first liquid bottoms stream, and second liquid bottoms stream have nitrogen contents of about 1% or less.

12. The process of claim 11, wherein the second vaporous overhead product has a methane content of about 1% or less.

13. The process of claim 1, wherein the second vaporous overhead product has a methane content of about 1% or less.

14. A process for removing nitrogen from a methane-containing feed gas during the production of a liquefied natural gas product using a two column cryogenic nitrogen rejection unit having a high pressure multistage distillation tower and a low pressure multistage distillation tower, the process comprising (a) separating the $C_{3+}$ components from the feed gas, (b) thereafter fractionating the feed gas in the high pressure multistage distillation tower into a first methane-rich liquid bottoms stream containing a reduced nitrogen content and a first vaporous overhead stream, (c) at least partially condensing the first vaporous overhead stream into a liquid intermediate stream, (d) separating the liquid intermediate stream in the low pressure multistage distillation tower into a second methane rich liquid bottoms stream containing a reduced nitrogen content and a second vaporous overhead stream containing a substantial portion of the nitrogen in the feed gas and a substantially reduced methane content, and (e) recovering the first methane-rich liquid bottoms stream, the second methane-rich liquid bottoms stream and the $C_{3+}$ components separated in step (a) as the liquid natural gas product.

15. The process of claim 1, wherein the liquid natural gas product has a nitrogen content of 4% or less.

16. The process of claim 15, wherein the first methane-rich liquid bottoms stream has a nitrogen content of 1% or less.

17. The process of claim 1, wherein the liquid natural gas product has a nitrogen content of 3% or less.

18. The process of claim 17, wherein the first methane-rich liquid bottoms stream has a nitrogen content of 1% or less.

19. The process of claim 1, wherein the liquid natural gas product has a nitrogen content of 2% or less.

20. The process of claim 19, wherein the first methane-rich liquid bottoms stream has a nitrogen content of 1% or less.

21. The process of claim 1, wherein the liquid natural gas product has a nitrogen content of 1% or less.

22. The process of claim 21, wherein the first methane-rich liquid bottoms stream has a nitrogen content of 1% or less.

23. The process of claim 1, wherein the liquid natural gas product has a nitrogen content 0.75% or less.

24. The process of claim 23, wherein the first methane-rich liquid bottoms stream has a nitrogen content of 1% or less.

25. The process of claim 1, wherein the liquid natural gas product has a nitrogen content of 0.5% or less.

26. The process of claim 25, wherein the first methane-rich liquid bottoms stream has a nitrogen content of 1% or less.

27. The process of claim 21, wherein cooling for liquefaction is provided by means of a multistage refrigerant cycle, the liquid natural gas product being recovered without recycle through the multistage refrigerant cycle.

28. The process of claim 1, wherein cooling for liquefaction is provided by means of multistage refrigerant cycle, the liquid natural gas product being recovered without recycle through the multistage refrigerant cycle.

29. In a process for producing a liquefied natural gas product containing less than 1% nitrogen in which a methane-containing feed gas is cooled at elevated pressure in a series of cooling steps until the gas condenses into a liquid and further in which the feed gas is also passed through a nitrogen recovery unit including multiple multistage distillation towers for removing nitrogen from the feed gas, a method for operating the nitrogen recovery unit to reduce power consumption comprising (a) separating the feed gas in a high pressure multistage distillation tower of the nitrogen recovery unit into a first methane-rich liquid bottoms stream containing a reduced nitrogen content and a first vaporous overhead stream, (b) cooling and depressurizing the first methane-rich bottoms stream to produce a portion of the liquefied natural gas product, (c) at least partially condensing the first vaporous overhead stream into a liquid intermediate stream, (d) separating the liquid intermediate stream in a low pressure multistage distillation tower into a second methane rich liquid bottoms stream containing a reduced nitrogen content and a second vaporous overhead stream containing a substantial portion of the nitrogen in the feed gas and a substantially reduced methane content, and (e) cooling and depressurizing the second methane-rich bottoms stream to produce another portion of the liquefied natural gas product.

30. The process of claim 29, wherein cooling for liquefaction is provided by means of multistage refrigerant cycle, the liquid natural gas product being recovered without recycle through the multistage refrigerant cycle.

31. The process of claim 30, wherein the nitrogen content of the first methane rich liquid bottoms stream is less than 1%, and further wherein the nitrogen content of the second methane rich liquid bottoms stream is less than 1%.

32. The process of claim 31, wherein the liquefied natural gas product has a pressure of about 1 psig.

33. The process of claim 30, wherein the liquefied natural gas product has a pressure of about 1 psig.

34. The process of claim 29, wherein the liquefied natural gas product has a pressure of about 1 psig.

* * * * *